US011713659B2

(12) United States Patent
Hong et al.

(10) Patent No.: US 11,713,659 B2
(45) Date of Patent: Aug. 1, 2023

(54) RETRIEVABLE HYDRAULICALLY ACTUATED WELL PUMP

(71) Applicant: Baker Hughes Oilfield Operations LLC, Houston, TX (US)

(72) Inventors: Lyon Euiyeol Hong, Luther, OK (US); Vishal Gahlot, Oklahoma City, OK (US)

(73) Assignee: BAKER HUGHES OILFIELD OPERATIONS, LLC, Houston, TX (US)

( * ) Notice: Subject to any disclaimer, the term of this patent is extended or adjusted under 35 U.S.C. 154(b) by 227 days.

(21) Appl. No.: 17/191,120

(22) Filed: Mar. 3, 2021

(65) Prior Publication Data

US 2021/0301637 A1 Sep. 30, 2021

Related U.S. Application Data

(60) Provisional application No. 62/994,632, filed on Mar. 25, 2020.

(51) Int. Cl.

| | |
|---|---|
| ***E21B 43/12*** | (2006.01) |
| ***F04B 47/04*** | (2006.01) |
| ***F04B 47/12*** | (2006.01) |

(52) U.S. Cl.

CPC ..... *E21B 43/129* (2013.01); *F04B 47/04* (2013.01); *F04B 47/12* (2013.01)

(58) Field of Classification Search

CPC ..... E21B 43/121; E21B 43/129; F04B 47/08; F04B 43/04

See application file for complete search history.

(56) References Cited

U.S. PATENT DOCUMENTS

| | | | | |
|---|---|---|---|---|
| 4,354,554 | A * | 10/1982 | Calhoun | F04D 13/10 166/321 |
| 4,516,917 | A | 5/1985 | Canalizo | |
| 7,814,969 | B2 | 10/2010 | Shaw | |
| 8,397,822 | B2 | 3/2013 | Tetzlaff et al. | |

(Continued)

FOREIGN PATENT DOCUMENTS

| | | | |
|---|---|---|---|
| EP | 3396168 | A1 | 10/2018 |
| WO | 2008106239 | A1 | 9/2008 |

OTHER PUBLICATIONS

International Search Report and Written Opinion of PCT Application No. PCT/US2021/023828 dated Jul. 14, 2021: pp. 1-8.

CN202180022699.X First Office Action dated May 7, 2023; 10 pgs.

*Primary Examiner* — Abiy Teka

(74) *Attorney, Agent, or Firm* — Bracewell LLP; Keith R. Derrington

(57) ABSTRACT

A well pump assembly has a tubular receptacle for attachment to a lower end of a string of production tubing. A docking station mounts to the receptacle, the docking station having a lower well fluid conduit for receiving well fluid from the well, a lower orientation guide, and a lower hydraulic connector. A hydraulic line extends alongside the receptacle and is in fluid communication with the lower hydraulic connector for supplying hydraulic fluid. A hydraulically actuated pump is configured to be lowered into and retrieved from the receptacle. A guide member on a lower end of the pump has an upper orientation guide, and an upper hydraulic connector in fluid communication with the pump, and an upper well fluid conduit leading to an intake of the pump.

20 Claims, 4 Drawing Sheets

(56) References Cited

U.S. PATENT DOCUMENTS

| | | | | |
|---|---|---|---|---|
| 8,985,972 | B2 | 3/2015 | Tetzlaff et al. | |
| 10,167,871 | B1 * | 1/2019 | Chen | H02K 7/1807 |
| 2009/0242212 | A1 | 10/2009 | Shaw | |
| 2009/0301705 | A1 | 12/2009 | McCreedy et al. | |
| 2011/0186302 | A1 * | 8/2011 | Coyle | E21B 43/121 166/372 |
| 2012/0118563 | A1 | 5/2012 | Tetzlaff et al. | |
| 2018/0187532 | A1 | 7/2018 | Bolt | |
| 2018/0313347 | A1 * | 11/2018 | Tolman | E21B 33/03 |
| 2020/0248680 | A1 * | 8/2020 | Lu | E21B 43/129 |

* cited by examiner

RETRIEVABLE HYDRAULICALLY ACTUATED WELL PUMP

CROSS-REFERENCE TO RELATED APPLICATION

This application claims priority to provisional application Ser. No. 62/994,632, filed Mar. 25, 2020.

FIELD OF THE DISCLOSURE

This disclosure relates in general to reciprocating well pumps, and in particular to a hydraulic pump with a guide on its lower end that stabs into a docking station at the lower end of a string of tubing to supply hydraulic pressure for the pump.

BACKGROUND

A variety of pumps are used in oil producing wells to pump well fluid to a wellhead assembly at an upper end of the well. The well fluid often comprises water, oil and gas. Typical pumps include rotary pumps, such as centrifugal or progressing cavity types, or they may be reciprocal pumps having a plunger that strokes upward and downward within a polished bore of a barrel or housing. The pump may be electrically driven by a downhole motor or, in the case of reciprocal pumps, stroked by a string of rods extending downward from the wellhead assembly.

Rod driven reciprocal pumps have concerns, such as rod tubing wear and system lower efficiency due to the extension and retraction of the rod string. Also surface environmental problems may occur at the stuffing box of the wellhead assembly.

Reciprocal well pumps powered by a surface hydraulic pump are also known. Normally, the hydraulic fluid pressure will be supplied from the surface down one or more hydraulic lines that extend alongside production tubing. Retrieving the reciprocal pump for maintenance and repair normally requires pulling the tubing and the hydraulic line.

SUMMARY

Figure 1:
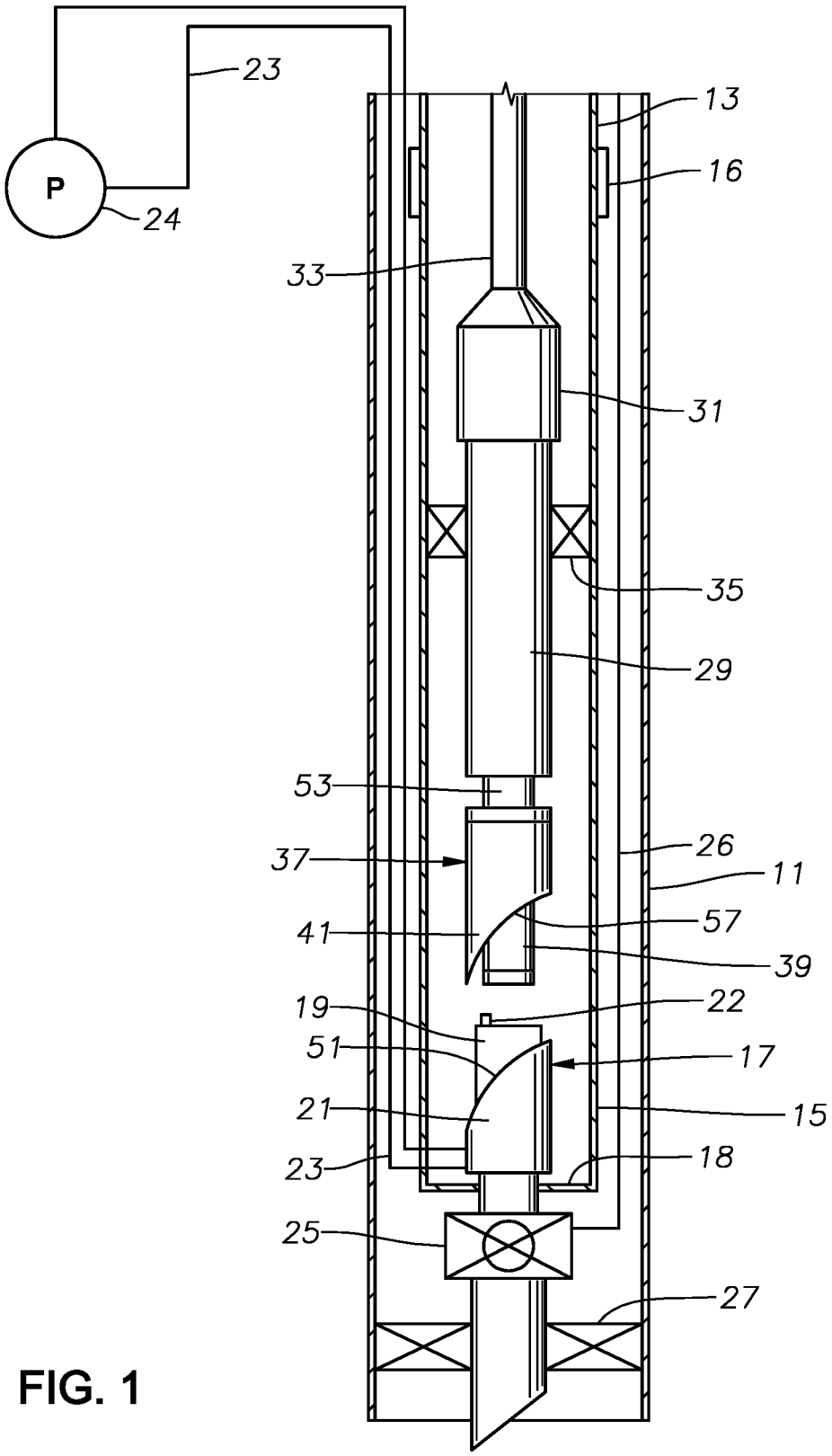
FIG. 1 is a schematic side view of a hydraulic pump with a guide and connector being lowered into connection with a docking station in accordance with this disclosure.

A well pump assembly comprises a tubular receptacle for attachment to a lower end of a string of production tubing. A docking station mounts to the receptacle, the docking station having a lower well fluid conduit for receiving well fluid from the well, a lower orientation guide, and a lower hydraulic connector. A hydraulic line extends alongside the receptacle and is in fluid communication with the lower hydraulic connector for supplying hydraulic fluid. A hydraulically actuated pump is configured to be lowered into and retrieved from the receptacle. A guide member on a lower end of the pump has an upper well fluid conduit leading to a well fluid intake of the pump, an upper orientation guide, and an upper hydraulic connector in fluid communication with the pump. As the pump is being lowered into the receptacle, the upper well fluid conduit slides into sealing engagement with the lower well fluid conduit while the upper orientation guide engages the lower orientation guide and rotationally orients the upper hydraulic connector into stabbing engagement with the lower hydraulic connector to supply hydraulic fluid pressure from the hydraulic line to the pump.

A latching arrangement between the guide member and the docking station secures the pump on the docking station after the upper and lower hydraulic connectors have stabbed into sealing engagement with each other. An upward pull of sufficient force on the pump causes the latching arrangement to release, enabling the pump to be retrieved from the receptacle.

In the embodiment shown, the lower orientation guide comprises a lower sleeve surrounding the lower well fluid conduit, the lower sleeve having an upward facing oblique cam edge. The upper orientation guide comprises an upper sleeve surround the upper well fluid conduit, the upper sleeve having a downward facing oblique cam edge that engages the upward facing oblique cam edge as the guide member lands on the docking station.

An upstroke chamber within the pump receives hydraulic fluid pressure to power the pump. An upper hydraulic passage within a sidewall of the upper well fluid conduit has an open upper end in the upstroke chamber. The upper hydraulic connector is mounted to a lower end of the upper hydraulic passage. A lower hydraulic passage within a sidewall of the lower well fluid conduit has a lower end connected to the hydraulic line. The lower hydraulic connector is mounted to an upper end of the lower hydraulic passage.

The embodiment shown discloses means for preventing well fluid entry into the upper hydraulic connector prior to stabbing engagement of the upper hydraulic connector with the lower hydraulic connector. It also shows means for preventing well fluid entry into the lower hydraulic connector prior to stabbing engagement with of the lower hydraulic connector with the upper hydraulic connector.

The pump shown comprises a plunger with a plunger bore that reciprocates within a pump housing, defining an upward stroke chamber. The pump has a traveling valve mounted to the plunger for movement in unison to lift well fluid into the production tubing during an upstroke. The pump has a standing valve mounted to the pump housing to admit well fluid into the bore of the plunger during a down stroke.

A seal may be located between the pump and the receptacle. The receptacle has a closed bottom in the embodiment shown. The docking station is mounted to an upper side of the bottom. The lower well fluid conduit extends downward through the bottom.

The embodiment shown discloses a detent on the lower well fluid conduit. A latch sleeve surrounds the upper well fluid conduit. The latch sleeve has a rib that snaps into engagement with the detent when the upper well fluid conduit slides into engagement the lower well fluid conduit. An upward pull of sufficient force releases the latch sleeve from the detent to enable retrieval of the pump.

DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1, a well has casing 11 cemented in place. A wellhead (not shown) at the upper end of the well supports a string of production tubing 13 in casing 11. A tubular receptacle 15 secures by a coupling 16 to the lower end of tubing 13 and defines a closed lower end of tubing 13. Receptacle 15 may be identical to other joints of tubing 13 except for having a closed lower end or bottom 18. The closed lower end 18 of receptacle 15 supports a docking station 17.

Docking station 17 has a lower conduit 19 that extends downward sealingly through closed lower end 18 of receptacle 15. Docking station 17 has a lower orientation guide 21 located within the interior of receptacle 15. The upper end of lower conduit 19 has one or more lower hydraulic fluid connectors 22 (only one shown). At least one hydraulic line 23 (two shown) extends from a hydraulic fluid supply pump 24 adjacent the wellhead down alongside tubing 13 to the lower end of receptacle 15. Each hydraulic line 23 supplies hydraulic fluid pressure delivered by supply pump 24 to one of the lower hydraulic fluid connectors 22.

The installation may have a downhole safety valve 25 located in lower conduit 19 below receptacle 15. If so, a control line 26 extends from the wellhead alongside tubing 13 and receptacle 15 to safety valve 25. Control line 26 controls safety valve 25 in one of several ways. For example, safety valve 25 may remain in an open position allowing upward well fluid flow through lower conduit 19 as long as hydraulic pressure remains in control line 26. The lower end of lower conduit 19 extends below safety valve 25 sealingly through a polished bore of a packer 27.

FIG. 1 shows a hydraulically actuated reciprocating pump 29 being lowered through tubing 13 for engagement with docking station 17. A running tool 31 lowered on a running string 33 releasably engages an upper end of reciprocating pump 29. Running string 33 would typically be either a wireline or coiled tubing. Running tool 31 may be a conventional tool that lowers and also retrieves equipment located in a well.

Reciprocating pump 29 may have an annular secondary seal member 35 on its exterior that will be in sealing engagement with the inner sidewall of receptacle 15 after landing. Annular seal member 35 could be an elastomer that swells in response to hydrocarbon in the well fluid. Alternately, it could be a cup seal that slides down the inner sidewall of tubing 13 during running. Or it could be a type that is energized by hydraulic fluid pressure supplied from a hydraulic line (not shown) extending to the wellhead. Annular seal member 35 helps prevent debris falling down production tubing 13 from accumulating on the bottom of receptacle 15. Annular seal member 35 also provides support as a centralizer of the downhole equipment during installation and operation. Reciprocating pump 29 has an open upper end or outlet above annular seal 35 for discharging well fluid into tubing 13.

An upper orientation guide member 37 secures to a lower end of reciprocating pump 29. Guide member 37 has an upper conduit 39 for receiving well fluid and an upper orientation guide 41 for engaging lower guide 21. While lowering reciprocating pump 29, upper guide 41 will engage lower guide 21, causing reciprocating pump 29 to rotate part of one turn and orient its hydraulic connector (not shown in FIG. 1) with lower hydraulic connector 22. Also, upper conduit 39 will stab into sealing engagement with lower conduit 19. After lower hydraulic connector 22 is in engagement with the upper hydraulic connector, running tool 31 may be retrieved, leaving reciprocating pump 29 in receptacle 15.

After annular seal 35 is in sealing engagement with the inner sidewall of receptacle 15. a supply pump (not shown) adjacent the wellhead can supply hydraulic fluid pressure down hydraulic lines 23 to reciprocating pump 29, causing it to operate. Well fluid flowing into the lower end of lower conduit 19 will enter upper conduit 39 and be pumped by reciprocating pump 29 into tubing 13 above annular seal 35.

Figure 2:
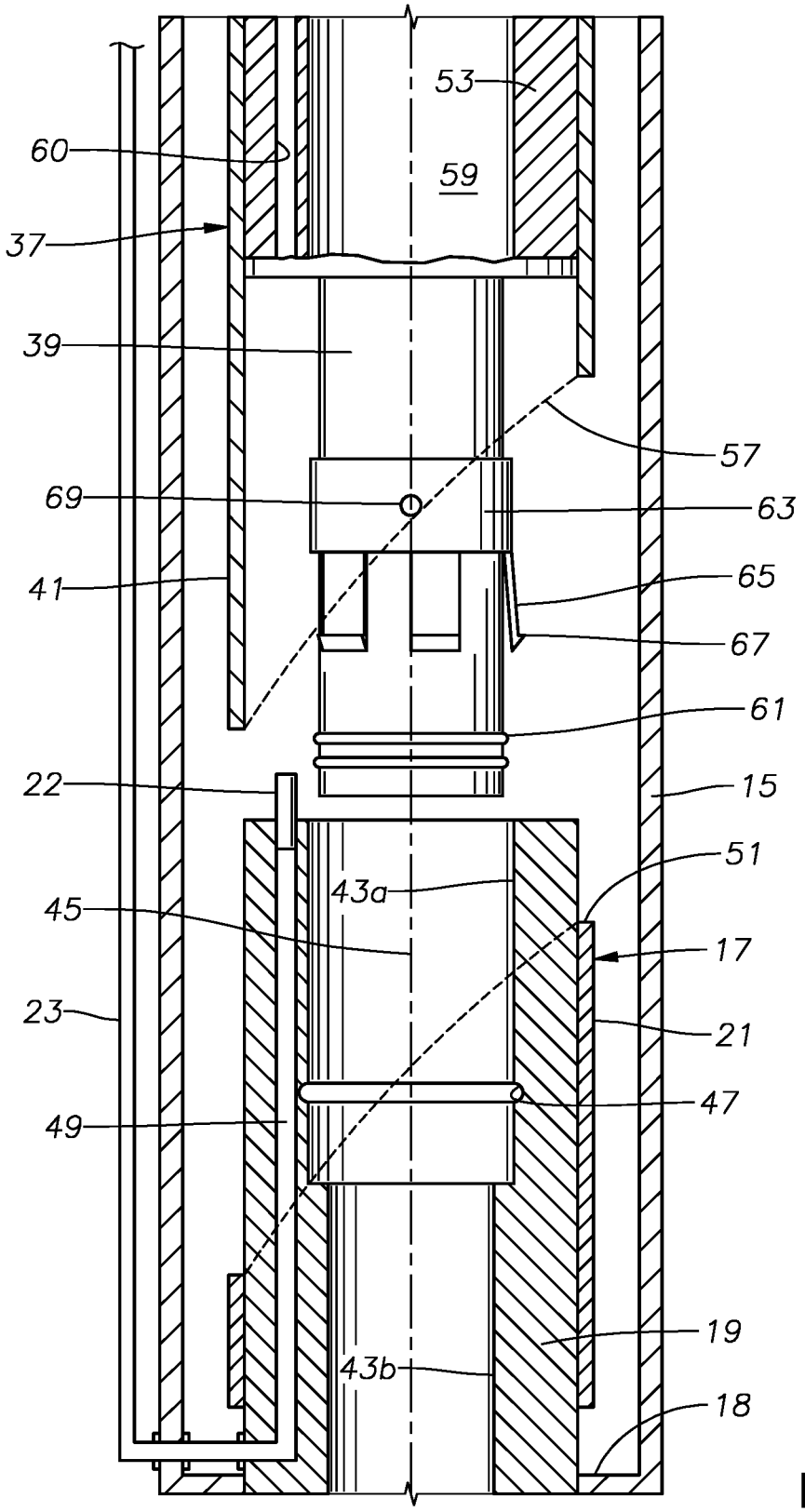
FIG. 2 is an enlarged, partly sectional view of the guide and connector being lowered into the docking station.

FIG. 2 illustrates more details of one embodiment of docking station 17. Lower conduit 19 may have a bore with and upper bore portion 43*a* slightly larger in inner diameter than a lower bore portion 43*b*. Upper and lower bore portions 43*a*, 43*b* have a longitudinal axis 45. A latching feature such as an annular recess 47 is formed in upper bore portion 43*a*. A lower hydraulic passage 49 extends through the sidewall of lower conduit 19 parallel with axis 45. The upper end of hydraulic passage 49 joins lower hydraulic connector 22. The lower end of hydraulic passage 49 extends laterally out the sidewall of lower conduit 19 and laterally through the sidewall of receptacle 15 to hydraulic line 23. Lower guide 21 is a sleeve that receives and rigidly secures, such as by threads, to the exterior of lower conduit 19. Lower guide 21 has an upward facing cam edge or surface 51 that may be in an oblique plane relative to axis 45.

Reciprocating pump 29 has a well fluid intake member 53 on its lower end. Upper conduit 39 secures to and extends downward from pump intake member 53. Pump intake member 53 may be considered to be a part of upper conduit 39. An upper hydraulic passage 60 extends through the sidewall of pump intake member 53 parallel with axis 45. Upper hydraulic passage 60 has a lower end at the lower end of pump intake 53.

Upper guide 41 is a sleeve that rigidly secures, as by threads, to pump intake 53. Upper guide 41 has downward facing upper cam edge or surface 57 that mates with lower cam surface 51. Upper cam surface 57 may be identical to lower cam surface 51. As upper guide 41 engages lower cam surface 51, the inclination of cam surfaces 57, 51 causes reciprocating pump 29 to orient and rotate less than one turn to axially align lower hydraulic connector 22 with an upper hydraulic connector at the lower end of upper hydraulic passage 60. A variety of other orientation mechanisms to rotate and axially align hydraulic connectors are feasible, such as a pin that engages an orientation cam slot.

Reciprocating pump 29 has an intake bore 59 in pump intake member 53. Upper conduit 39 has one or more seal rings 61 that will sealingly engage lower conduit upper bore portion 43*a* in this example. Upper conduit 39 also has a latch 63 that snaps into engagement with latching recess 47. In this example, latch 63 is a collet sleeve that extends around upper conduit 39. Latch 63 has a number of resilient fingers 65 that incline slightly outward relative to the exterior of upper conduit 39. Each finger 65 has a rib 67 on its lower end that slides into lower conduit upper bore portion 43*a*, then snaps outward into engagement with latching recess 47. Latch 63 prevents upward movement of upper conduit 39 relative to docking station 17. One or more shear pins 69 may secure latch 63 to upper conduit 39. When pump 29 is in its lowermost position, the lower end of intake member 53 will abut the upper end of lower conduit 19.

To retrieve reciprocating pump 29, an upward force applied from a retrieving string and fishing tool (not shown) will cause shear pins 69 to shear, enabling upward movement of upper conduit 39 relative to latch 63. Fingers 65 deflect inward as upper conduit 39 moves upward, releasing latch 63 from lower conduit 19. Optionally, a shoulder or the like at the lower end of upper conduit 39 retains latch 63 on upper conduit 39 during retrieval. A variety of other mechanisms for latching upper conduit 39 in lower conduit 19 are feasible.

Figure 3:
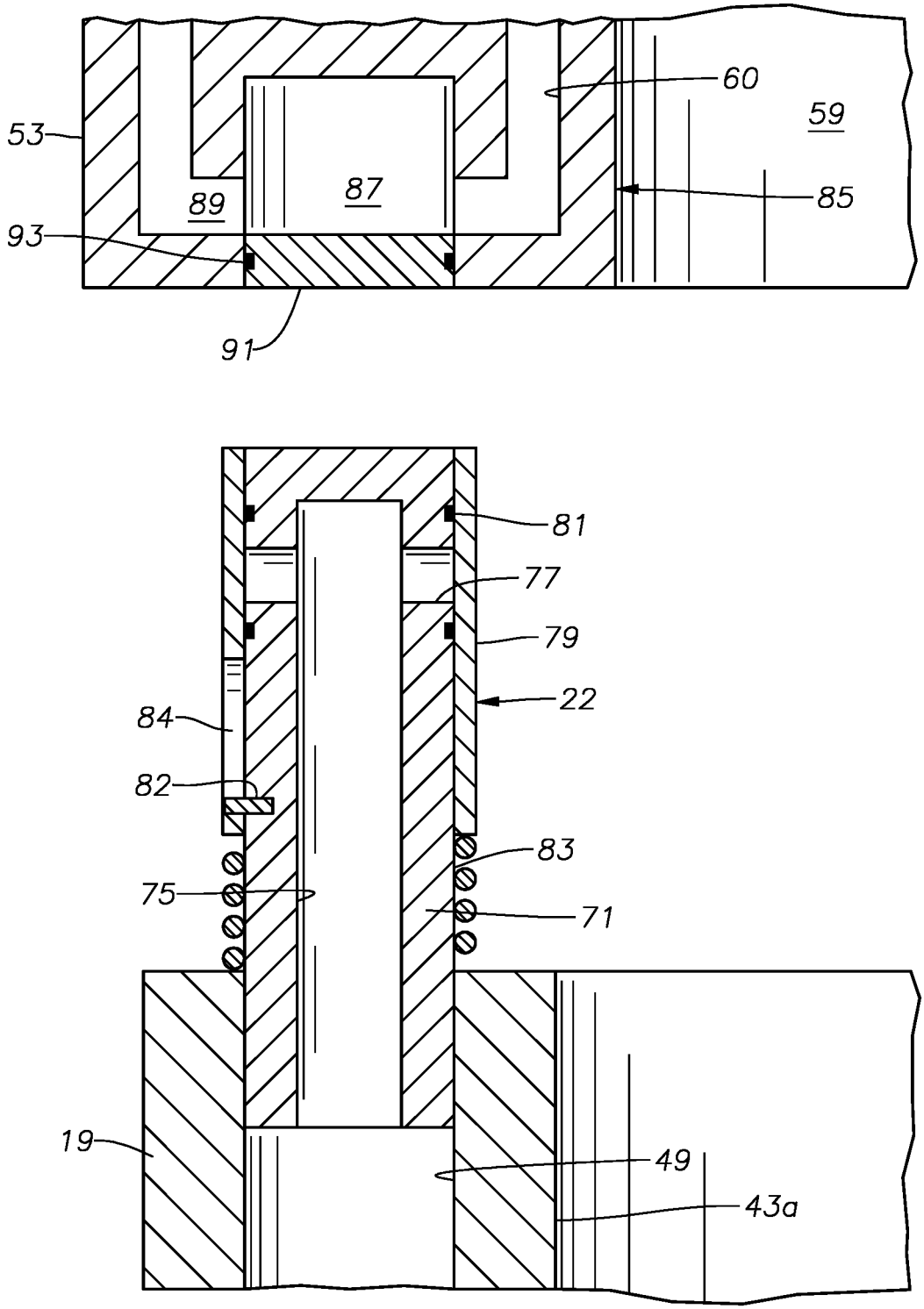
FIG. 3 is an enlarged, partly sectional and exploded view of one of the hydraulic connectors of the guide and connector of FIG. 2.

FIG. 3 shows schematically one example of lower hydraulic connector 22 and how it fits with a connector associated with upper hydraulic passage 60. In this example, lower hydraulic connector 22 is a male member, but it could be a female member or receptacle, instead, and the male member connected to upper hydraulic passage 60. Lower hydraulic connector 22 includes a pin 71 that protrudes upward from the upper end or rim of lower conduit 19. A lower portion of pin 71 is rigidly secured in lower conduit hydraulic passage 49, such as by threads or by a press-fit. Pin 71 has a hole 75 that extends parallel to axis 45 from an opening at the lower end to a closed upper end. One or more lateral outlet ports 77 extend outward from hole 75 just below the closed upper end of hole 75.

A valve or sliding sleeve 79 closely receives the upper portion of pin 71. Pin 71 has seal rings 81 that seal to sliding sleeve 79 above and below outlet ports 77 when sliding sleeve 79 is in the closed position shown. A coil spring 83 encircles pin 71 and urges sliding sleeve 79 upward to the closed position shown. A retaining pin 82 extends laterally outward from the exterior of pin 71 into an axially elongated slot 84 in sleeve 79 to provide a positive upper stop for sliding sleeve 79. Retaining pin 82 and slot 84 allow sleeve 79 to move downward on pin 71, compressing spring 83.

Upper hydraulic connector 85 includes a receptacle 87 extending upward from the lower end of pump intake member 53 and having a closed upper end. One or more outlet ports 89 extend laterally outward from passage 87 and join upper hydraulic passage 60. A moveable valve or closure member 91 has a seal ring 93 that seals receptacle 87 below outlet ports 89. Closure member 91 is a sliding disk capable of sliding upward in receptacle 87 past outlet ports 89

When pump intake member 53 moves downward onto lower conduit 19, pin 71 will engage and push closure member 91 upward while pump intake member 53 continues downward movement. This results in outlet ports 89 opening. Sliding sleeve 79 has a larger diameter than the lower end of receptacle 87, thus the downward movement of pump intake member 53 pushes sliding sleeve 79 downward on pin 71, compressing spring 83 and causing pin outlet ports 77 to register with receptacle outlet ports 89. Hydraulic fluid from lower hydraulic passage 49 may flow upward into upper hydraulic passage 60. Other arrangements to connect hydraulic passages as reciprocating pump 29 is being run are feasible.

Sliding sleeve 79 and outlet ports 77 serve as means to prevent well fluid entry into lower hydraulic passage 49 prior to stabbing engagement of lower hydraulic connector 22 with upper hydraulic connector 85. Sliding disk 91 and outlet ports 89 serve as means to prevent well fluid entry into upper hydraulic passage 60 prior to stabbing engagement of upper hydraulic connector 85 with lower hydraulic connector 22.

Figure 4:
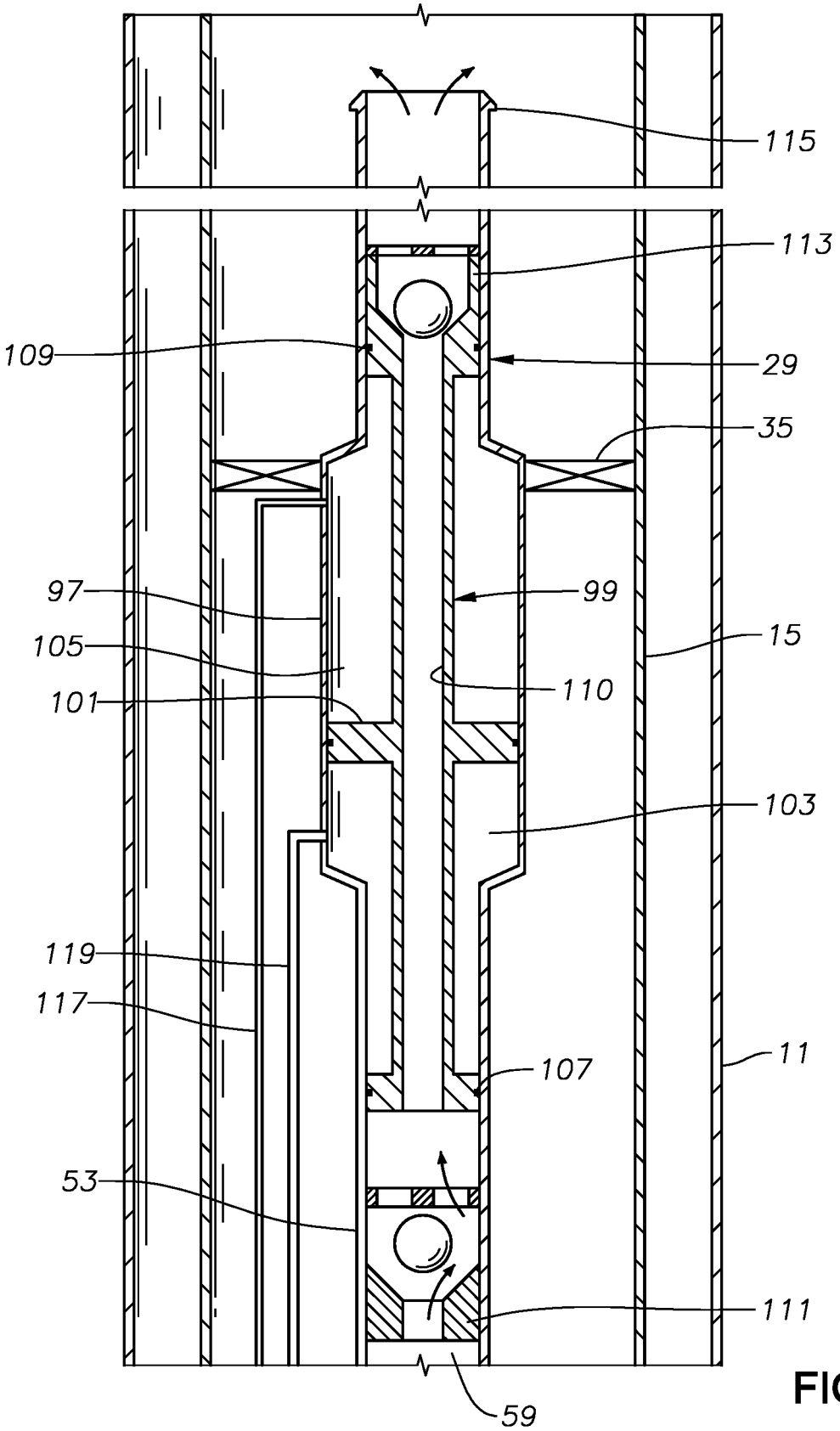
FIG. 4 is a schematic sectional view of the hydraulic pump of FIG. 1.

FIG. 4 shows one schematic example of a double acting hydraulic actuated reciprocating pump 29, but single acting hydraulic actuated reciprocating pumps are feasible. Reciprocating pump 29 has a housing or barrel 97 in which a plunger 99 reciprocates. Plunger 99 has a piston 101 that slides against the inner wall of housing 97, defining an up stroke chamber 103 below piston 101 and a down stroke chamber 105 above piston 101. Lower and upper seals or sealing surfaces 107, 109 on plunger 99 above and below piston 101 define the opposite ends of chambers 103, 105. Seals 107, 109 slide within polished bore portions of housing 97 that are smaller in inner diameter than the portion in which piston 101 slides. Plunger 99 has a bore 110 that extends axially through it for well fluid flow. The portions of plunger 99 extending upward and downward from piston 101 could have the same diameters as seals 107, 109.

A conventional standing valve 111 is mounted in hydraulic pump intake member 53 for opening and closing flow to a lower end of plunger bore 110. A conventional travelling valve 113 is mounted to plunger 99 for opening and closing flow out an upper end of bore 110. Housing 97 has a fishing neck 115 on its upper end structured for engagement by running tool 31 (FIG. 1). The upper end of fishing neck 115 is open for discharging well fluid into tubing 13 above annular seal 35.

Upper hydraulic passage 60 (FIG. 2) connects to a hydraulic fluid line 117 that leads to up stroke chamber 103. If a double acting hydraulic pump is employed, as shown, another hydraulic fluid line 119 leads from another upper hydraulic passage 60 (FIG. 2) to down stroke chamber 105. Hydraulic lines 117, 119 can be external to reciprocating pump 29, as shown, or internal. If the hydraulic pump is single acting, hydraulic pressure would be provided only for the up stroke. The weight of well fluid in tubing 13 previously pumped would force plunger 99 back downward.

Hydraulic fluid pressure supply pump 24 (FIG. 1) to one of the upper hydraulic passages 60 for the double acting reciprocating pump 29 shown would pass through hydraulic fluid line 117 to up stroke chamber 103. Upward movement of piston 101 causes travelling valve 113 to close and lifts the well fluid contained in tubing 13. The upward movement opens standing valve 111, admitting well fluid into plunger bore 110 below travelling valve 113. When reaching the upper end of the stroke, the hydraulic pressure from supply pump 24 at the upper end of the well is applied to hydraulic line 119, which pushes piston 101 and plunger 99 downward. Travelling valve 113 opens to admit well fluid from plunger bore 110 into tubing 13, and standing valve 111 closes to prevent downward flow of well fluid out of plunger bore 110.

The present disclosure described herein, therefore, is well adapted to carry out the objects and attain the ends and advantages mentioned, as well as others inherent therein. The hydraulic pump can be installed and retrieved through the production tubing. The hydraulic line or lines are installed while the tubing is being run and remain in place while the hydraulic pump is installed and retrieved.

While only one embodiment of the disclosure has been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. A well pump assembly, comprising:

a tubular receptacle for attachment to a lower end of a string of production tubing;

a docking station mounted to the receptacle, the docking station having a lower well fluid conduit for receiving well fluid from the well, a lower orientation guide, and a lower hydraulic connector;

a hydraulic line extending alongside the receptacle and in fluid communication with the lower hydraulic connector for supplying hydraulic fluid;

a hydraulically actuated pump configured to be lowered into and retrieved from the receptacle;

a guide member on a lower end of the pump, the guide member having an upper well fluid conduit leading to an intake of the pump, an upper orientation guide, and an upper hydraulic connector in fluid communication with the pump; and wherein as the pump is being lowered into the receptacle, the upper well fluid conduit slides into sealing engagement with the lower well fluid conduit while the upper orientation guide engages the lower orientation guide and rotationally orients the upper hydraulic connector into stabbing engagement with the lower hydraulic connector to supply hydraulic fluid pressure from the hydraulic line to the pump.

2. The assembly according to claim 1, further comprising:

a latching arrangement between the guide member and the docking station that secures the pump on the docking station after the upper and lower hydraulic connectors have stabbed into sealing engagement with each other; and wherein an upward pull of sufficient force on the pump causes the latching arrangement to release, enabling the pump to be retrieved from the receptacle.

3. The assembly according to claim 1, wherein:

the lower orientation guide comprises a lower sleeve surrounding the lower well fluid conduit, the lower sleeve having an upward facing oblique cam edge; and the upper orientation guide comprises an upper sleeve surround the upper well fluid conduit, the upper sleeve having a downward facing oblique cam edge that engages the upward facing oblique cam edge as the guide member lands on the docking station.

4. The assembly according to claim 1, further comprising:

a chamber within the pump for receiving hydraulic fluid pressure to power the pump;

an upper hydraulic passage in fluid communication with the chamber, the upper hydraulic connector being mounted to a lower end of the upper hydraulic passage; and a lower hydraulic passage in fluid communication with the hydraulic line, the lower hydraulic connector being mounted to an upper end of the lower hydraulic passage.

5. The assembly according to claim 1, further comprising:

means for preventing well fluid entry into the upper hydraulic connector prior to stabbing engagement of the upper hydraulic connector with the lower hydraulic connector; and means for preventing well fluid entry into the lower hydraulic connector prior to stabbing engagement of the lower hydraulic connector with the upper hydraulic connector.

6. The assembly according to claim 1, wherein the pump comprises:

a plunger with a plunger bore that reciprocates within a pump housing, defining an upward stroke chamber, the pump having a traveling valve mounted to the plunger for movement in unison to lift well fluid into the production tubing during an upstroke, and a standing valve mounted to the pump housing to admit well fluid into the plunger bore during a down stroke.

7. The assembly according to claim 1, further comprising:

a seal between the pump and the receptacle.

8. The assembly according to claim 1, wherein:

the receptacle has a closed bottom;

the docking station is mounted to an upper side of the bottom; and the lower well fluid conduit extends downward through the bottom.

9. The assembly according to claim 1, further comprising:

a detent on the lower well fluid conduit;

a latch sleeve surrounding the upper well fluid conduit, the latch sleeve having a rib that snaps into engagement with the detent when the upper well fluid conduit slides into engagement the lower well fluid conduit; and wherein an upward pull of sufficient force releases the latch sleeve from the detent to enable retrieval of the pump.

10. A well pump assembly, comprising:

a hydraulic fluid supply pump for positioning adjacent a wellhead of a well;

a tubular receptacle for attachment to a lower end of a string of production tubing extending into the well, the receptacle having a closed bottom;

a docking station mounted within the receptacle, the docking station having a lower well fluid conduit that extends downward through the closed bottom for receiving well fluid from the well, the docking station having a lower orientation guide and a lower hydraulic connector;

a hydraulic line extending from the supply pump alongside the receptacle and in fluid communication with the lower hydraulic connector for supplying hydraulic fluid;

a hydraulically actuated reciprocating pump;

a fishing neck on an upper end of the reciprocating pump for lowering into and retrieving the reciprocating pump from the receptacle with a running string;

a guide member on a lower end of the reciprocating pump, the guide member having an upper orientation guide, an upper hydraulic connector in fluid communication with the reciprocating pump, and an upper well fluid conduit leading to a well fluid intake of the reciprocating pump; and wherein as the reciprocating pump is being lowered into the receptacle, the upper well fluid conduit slides into sealing engagement with the lower well fluid conduit while the upper orientation guide engages the lower orientation guide and rotationally orients the upper hydraulic connector into stabbing engagement with the lower hydraulic connector to supply hydraulic fluid pressure from the supply pump to the reciprocating pump.

11. The assembly according to claim 10, further comprising:

a latching arrangement between the guide member and the docking station that secures the reciprocating pump on the docking station after the upper and lower hydraulic connectors have stabbed into sealing engagement with each other; and wherein an upward pull of sufficient force on the fishing neck causes the latching arrangement to release, enabling the reciprocating pump to be retrieved from the receptacle.

12. The assembly according to claim 10, wherein:

the lower orientation guide comprises a lower sleeve surrounding the lower well fluid conduit, the lower sleeve having an upward facing oblique cam edge; and the upper orientation guide comprises an upper sleeve surrounding the upper well fluid conduit, the upper sleeve having a downward facing oblique cam edge that engages the upward facing oblique cam edge as the guide member lands on the docking station.

13. The assembly according to claim 10, further comprising:

an upstroke chamber within the reciprocating pump for receiving hydraulic fluid pressure to power the reciprocating pump;

an upper hydraulic passage in fluid communication with the upstroke chamber, the upper hydraulic connector being mounted to a lower end of the upper hydraulic passage; and a lower hydraulic passage in fluid communication with the hydraulic line, the lower hydraulic connector being mounted to an upper end of the lower hydraulic passage.

14. The assembly according to claim 10, further comprising:

a lower valve mounted to the lower hydraulic connector, the lower valve having an open and a closed position and being in the closed position to prevent well fluid entry into the lower hydraulic connector prior to stabbing engagement of the upper hydraulic connector with the lower hydraulic connector;

an upper valve mounted to the upper hydraulic connector, the upper valve having an open and a closed position and being in the closed position to prevent well fluid entry into the upper hydraulic connector prior to stabbing engagement with of the lower hydraulic connector with the upper hydraulic connector; and wherein the stabbing engagement of the upper hydraulic connector with the lower hydraulic connector causes the lower valve and the upper valve to move to the open positions.

15. The assembly according to claim 10, wherein the reciprocating pump comprises:

a plunger with a plunger bore that reciprocates within a pump housing, defining an upward stroke chamber, the reciprocating pump having a traveling valve mounted to the plunger for movement in unison to lift well fluid into the production tubing during an upstroke, and a standing valve mounted to the pump housing to admit well fluid into the bore of the plunger during a down stroke.

16. A well pump assembly, comprising:

a hydraulic fluid supply pump for positioning adjacent a wellhead of a well;

a tubular receptacle for attachment to a lower end of a string of production tubing;

a docking station mounted to a lower end of the receptacle, the docking station having within the receptacle a lower well fluid conduit, a lower orientation guide, and a lower hydraulic connector;

a hydraulic line extending from the supply pump alongside the receptacle to the lower hydraulic connector for supplying hydraulic fluid;

a well fluid reciprocating pump having a plunger with a plunger bore that reciprocates within a pump housing, defining an upward stroke chamber, the reciprocating pump having a traveling valve mounted to the bore of the plunger for movement in unison to lift well fluid into the production tubing during an upstroke, and a standing valve mounted to the pump housing to admit well fluid into the bore of the plunger during a down stroke;

a guide member mounted to a lower end of the pump housing, the guide member having an upper well fluid conduit, an upper orientation guide, and an upper hydraulic connector, the upper hydraulic connector being in fluid communication with the upward stroke chamber;

a fishing neck on an upper end of the pump housing for running the reciprocating pump and the guide member into the receptacle, wherein during running, the upper orientation guide engages the lower orientation guide and rotates the upper hydraulic connector into orientation for stabbing engagement with the lower hydraulic connector, and the upper well fluid conduit sealingly engages the lower well fluid conduit;

a latching arrangement between the guide member and the docking station that secures the reciprocating pump on the docking station after the upper and lower hydraulic connectors have stabbed into sealing engagement with each other; and wherein an upward pull of sufficient force on the fishing neck causes the latching arrangement to release, enabling the reciprocating pump to be retrieved from the receptacle.

17. The assembly according to claim 16, further comprising:

an annular seal member between the pump housing and the receptacle; and wherein the pump housing has an outlet that discharges well fluid into the receptacle above the seal member.

18. The assembly according to claim 16, wherein:

the lower orientation guide comprises a lower sleeve surrounding the lower well fluid conduit, the lower sleeve having an upward facing oblique cam edge; and the upper orientation guide comprises an upper sleeve surround the upper well fluid conduit, the upper sleeve having a downward facing oblique cam edge that engages the upward facing oblique cam edge as the guide member lands on the docking station.

19. The assembly according to claim 16, further comprising:

an upper hydraulic passage having an open upper end in fluid communication with the upstroke chamber, the upper hydraulic connector being mounted to a lower end of the upper hydraulic passage; and a lower hydraulic passage within a sidewall of the lower well fluid conduit and extending parallel with the axis of the reciprocating pump, the lower hydraulic passage having a lower end connected to the hydraulic line, the lower hydraulic connector being mounted to an upper end of the lower hydraulic passage.

20. The assembly according to claim 16, further comprising:

a lower valve mounted to the lower hydraulic connector, the lower valve having an open and a closed position and being in the closed position to prevent well fluid entry into the lower hydraulic connector prior to stabbing engagement of the upper hydraulic connector with the lower hydraulic connector;

an upper valve mounted to the upper hydraulic connector, the upper valve having an open and a closed position and being in the closed position to prevent well fluid entry into the upper hydraulic connector prior to stabbing engagement of the lower hydraulic connector with the upper hydraulic connector; and wherein the stabbing engagement of the upper hydraulic connector with the lower hydraulic connector causes the lower valve and the upper valve to move to the open positions.

* * * * *